US011491409B2

(12) United States Patent
Beutler

(10) Patent No.: US 11,491,409 B2
(45) Date of Patent: Nov. 8, 2022

(54) VEHICLE WITH PASSENGER ACCOMMODATION WHICH CAN BE SWIVELLED AND/OR ROTATED

(71) Applicant: Joerg Beutler, Holzkirchen (DE)

(72) Inventor: Joerg Beutler, Holzkirchen (DE)

( * ) Notice: Subject to any disclaimer, the term of this patent is extended or adjusted under 35 U.S.C. 154(b) by 493 days.

(21) Appl. No.: 16/580,238

(22) Filed: Sep. 24, 2019

(65) Prior Publication Data

US 2020/0094156 A1 Mar. 26, 2020

(30) Foreign Application Priority Data

Sep. 24, 2018 (DE) ..... 20 2018 105 473.2

(51) Int. Cl.
*A63G 31/02* (2006.01)
*A63G 7/00* (2006.01)

(52) U.S. Cl.
CPC ..... *A63G 31/02* (2013.01)

(58) Field of Classification Search
CPC ..... A63G 7/00
USPC ..... 472/45–47; 104/75
See application file for complete search history.

(56) References Cited

U.S. PATENT DOCUMENTS

| | | | | |
|---|---|---|---|---|
| 2,048,215 | A | 7/1936 | Miller | |
| 6,220,171 | B1 | 4/2001 | Hettema et al. | |
| 3,057,317 | A1 | 11/2011 | Roodenburg et al. | |
| 9,162,150 | B2 | 10/2015 | Roodenburg et al. | |
| 9,486,135 | B1 * | 11/2016 | Fram | B61B 3/02 |
| 9,962,617 | B2 | 5/2018 | Zamperla | |
| 10,881,973 | B2 * | 1/2021 | Swasey | A63G 27/02 |
| 2009/0120319 | A1 | 5/2009 | Muller et al. | |
| 2009/0126596 | A1 | 5/2009 | Threlkel | |
| 2011/0088584 | A1 | 4/2011 | Baker et al. | |
| 2018/0080214 | A1 | 3/2018 | Berkowitz et al. | |
| 2018/0290062 | A1 | 10/2018 | Hu et al. | |
| 2019/0091586 | A1 * | 3/2019 | Walser | A63G 21/20 |

FOREIGN PATENT DOCUMENTS

| | | | |
|---|---|---|---|
| CN | 103386197 | A | 11/2013 |
| DE | 199 00 528 | A1 | 9/2000 |
| DE | 10 2007 052 825 | A1 | 5/2009 |
| DE | 601 33 610 | T2 | 6/2009 |
| EP | 1201280 | A2 | 5/2002 |
| EP | 3 216 503 | A1 | 9/2017 |
| GB | 189921798 | A | 10/1900 |
| WO | 2006/049484 | A1 | 5/2006 |
| WO | 2007/136245 | A1 | 11/2007 |
| WO | 2012/039601 | A1 | 3/2012 |

(Continued)

OTHER PUBLICATIONS

DE Search Report, dated Jun. 6, 2019, from corresponding DE application No. 20 2018 105 473.2.

(Continued)

*Primary Examiner* — Kien T Nguyen
(74) *Attorney, Agent, or Firm* — Nixon & Vanderhye

(57) ABSTRACT

Disclosed is a vehicle for an amusement facility has a chassis, a passenger accommodation and a connecting element in the form a pendulum bar. The lower end of the pendulum bar is rigidly connected to the passenger accommodation; the upper end is connected to the chassis via a joint such that it can be rotated and/or swivelled. The pendulum is connected to the chassis via a joint.

17 Claims, 3 Drawing Sheets

(56) References Cited

FOREIGN PATENT DOCUMENTS

| | | | |
|---|---|---|---|
| WO | 2016/176908 | A1 | 11/2016 |
| WO | 2018/093831 | A1 | 5/2018 |

OTHER PUBLICATIONS

Extended European Search Report issued in European Patent Application No. 19193819.0 dated Jan. 3, 2020 with English machine translation provided.
Office Action issued in Chinese Patent Application No. 201910903419.0 dated Jun. 6, 2022.

* cited by examiner

VEHICLE WITH PASSENGER ACCOMMODATION WHICH CAN BE SWIVELLED AND/OR ROTATED

TECHNICAL SCOPE

The present invention relates to a rail-guided vehicle with a passenger accommodation which can be swivelled and/or rotated, as well as to an amusement facility having a guiding device and such a vehicle.

PRIOR ART

Amusement facilities such as roller-coasters are known in various designs with different track designs and ride patterns. In addition to spectacular turns, it is known to integrate loops, roll-overs, etc. into the track design.

Generally, roller-coasters are known in which vehicles are arranged above the track (during entry/exit of passengers) as well as roller-coasters in which the vehicles are arranged below the track(s) (during entry/exit of passengers), as in a gondola, for example. These are referred to as "suspended coasters" or "inverted coasters".

Usually, the vehicle mimics the motions dictated by the track design in both variants. The passenger experiences different forces during a ride (lateral, from above/below, stronger/weaker forces).

However, the possible variations are limited by the track design. This means that the possible designs of the ride experience are limited as well. Therefore, vehicles were introduced in which the passenger accommodations perform additional motions, such as rotations, relative to the direction of travel, such that the passenger experiences overlapping motions from the track profile and the additional motion. This can lead to an improvement of the ride experience and increases the possibilities of creating different sensations during the ride.

However, even with the help of this latter variant, in which the track profile and the additional motions can be varied, not all desired effects can be created.

Object of the Invention

Based on this, the object of the present invention is to provide a rail-guided vehicle which offers special ride effects, as well as to provide a corresponding amusement facility.

Technical Solution

This object is solved by a rail-guided vehicle according to Claim 1 as well as by an amusement facility according to Claim 7 or 8. Advantageous characteristics and preferred embodiments follow from the dependent claims.

The rail-guided vehicle according to the invention has a passenger accommodation which has at least one seat with a seating and a seat back for the seated accommodation of a passenger, wherein the intended viewing direction of the seated passenger essentially is oriented perpendicularly to the surface of the seat back, and wherein the seats are arranged such that the viewing direction is oriented transversely to the direction of travel, wherein the passenger accommodation is arranged such that it can be swivelled and/or rotated about an axis that essentially is oriented in the viewing direction. In particular, the seats can be oriented such that the viewing direction (essentially) is oriented perpendicularly to the direction of travel.

The axis is arranged above the passengers to generate a pendulum effect.

The vehicle in particular is used as an amusement vehicle in amusement facilities which are intended to generate particular ride experiences, such as roller-coasters. The vehicles preferably have a rail-guided chassis. The passenger accommodation is connected to the chassis via a connecting element (joint). The connection between one end of the (preferably rigid within itself) connecting element and the passenger accommodation can be essentially rigid, while the other end of the connecting element can be rotatably connected to the chassis. However, the connection does not necessarily have to be rigid; it also can be rotatable in addition, for example. The passenger accommodation and the connecting element together can form a pendulum, which can be swivelled by a defined angle. It also is conceivable that the connecting element represents the axis which extends from the chassis in the viewing direction and about which the chassis then rotates.

Thus, a preferred design is that in which the passenger accommodation forms a pendulum which can be swivelled about an axis arranged above the passengers (that is, above their centre of gravity). The axis in particular can be formed by a direct connection of the rotational axis on the chassis to the seats (which can be mounted rigidly or rotatably) via a rigid (and joint-less) pendulum bar. In this manner, a kinematics is realized which is simple and yet versatile in terms of the motions of the passenger accommodation.

The pendulum axis which can be swivelled and/or rotated can be arranged directly on the chassis via a joint, for example; the seats can be rigidly or rotatably mounted on the other side of the pendulum. The pendulum preferably has a rigid rotational axis. The seats in particular are arranged below the chassis and below the rigid rotational axis.

In the scope of the invention, the desired motion of the passenger accommodation preferably is generated by no more than two, preferably only one, rotational axis/axes between chassis and passenger accommodation. The motion of the passenger accommodation is generated via the axis, or axes, on the one hand, and via the three-dimensional routing of the guiding device, which typically is designed as a guide rail, on the other hand. The guiding device can have straight, twisted and/or curved portions.

Overall, the motion of the passenger accommodation can be generated in a simple manner, using a small number of swivel joints between chassis and passenger accommodation.

In a preferred embodiment the passenger accommodation can be swivelled or rotated by 360°. The viewing direction is defined as an axis which is oriented (essentially) perpendicular to the surface of the seat back of the seat or, respectively, the seats. The axis can be arranged on the vehicle in any desired fashion. In particular, the swivel or rotational axis can either intersect the seat back or not. If it does not intersect the same, it is arranged with a parallel offset on the connecting element and/or the chassis. In principle, the swivel or rotational axis can be arranged in any desired location parallel to the viewing direction, but in particular in such a way that a pendulum effect is generated for the vehicle.

The axis in particular can be arranged in the centre of gravity of the passengers and/or the axis can be arranged above the passengers to generate a pendulum effect. In particular, the connecting element or the chassis can have a joint which establishes the rotatable connection between chassis and passenger accommodation. The joint can in particular be arranged in proximity to the chassis on the connecting element or directly on the chassis. The axis essentially extends through the joint.

The passenger accommodation can be designed as a seat cluster with or without a floor plate.

The vehicle can have a chassis, wherein the swivelling or rotating motion of the passenger accommodation relative to the chassis is generated by centrifugal forces and/or gravitational forces generated during a ride along a rail structure and/or by the gravitational force and/or by gravitational forces and/or by a shifting link (by means of which the travelling motion of the vehicle is used to generate the rotating motion) and/or by a motor drive. Due to the increased speed while passing through a turn, the centrifugal force acting upon the passenger accommodation increases, which in turn increases the swing of the "pendulum", up to a roll-over. The pendulum effect ensures that the passengers are pressed into their seats when passing through turns, while experiencing low lateral forces.

The vehicle can have a dampening and/or locking element for dampening and/or blocking the swivelling or rotating motion. In particular, the locking element is actuated to lock the vehicle in place in order to guarantee a comfortable entry and exit at a terminal. The pendulum motion can be dampened by a hydraulic system, for example, which also allows for a controlled blocking of the pendulum.

In a particular embodiment of the invention, the vehicle has an automatic and/or interactive speed control for generating a specific centrifugal force in a specific portion of the track and/or for controlling the rotational motion in this portion of the track.

The speed control can, for example, be conducted by controlling a positive drive provided in this portion of the track, or by controlling other drive variants such as friction wheels, cable drives, linear motors, etc., in order to control the rotational motion via a change in the centrifugal force (up to 360° roll-overs). Even the number of 360° roll-overs while passing through a turn could be varied by the passengers via an appropriate interactive control.

Aside from an interactive speed control, the vehicle could have adjusting devices which permit further interactive adjustments. For example, an option could be provided to block the swivelling/rotating motion during the ride. In this case, the forces acting upon the passenger when passing through a turn would be different from those experienced when the pendulum effect is activated (i.e. without blocking). In particular, the passenger would experience higher lateral forces. Dampening of the pendulum effect or, respectively, the rotation could be continuously adjustable.

The vehicle can be propelled by gravity, by a cable or chain drive, by a hydraulic or pneumatic cylinder, by a linear motor, by friction wheels or by an internal drive, and it can have corresponding devices used for being driven by gravity, a cable drive, a linear motor, friction wheels or an internal drive.

The propelling force of an internal drive of the vehicle can be transferred positively onto a rail structure. The amusement facility, for example, may have an engaging element arranged on the track in a stationary manner, for example a toothed rack or a chain, which interacts with a drive gear of the vehicle. This could, for example, be a gear wheel, which engages with the engaging element, at least in defined track portions.

An amusement facility according to the invention comprises a guiding device for guiding a vehicle, for example a track system, and a vehicle as described in this application. The guiding device defines or forms a track portion, in which a chassis of the vehicle essentially is guided in a vertical plane. For example, a vertical arc could be provided, through which the passenger accommodation travels laterally to the rail.

Another amusement facility according to the invention comprises a guiding device for guiding a vehicle and a vehicle as described in this application. The guiding device forms or defines a track portion, in which the normal vector of a chassis of the vehicle essentially is guided in a vertical plane. This means that a ride element is provided, in which the pendulum swivels by 180° after the vehicle has passed the highest point of the arc, such that the passenger accommodation once again hangs downward.

The guiding device can be arranged along the track in such a manner that the vehicle travels through vertical and/or horizontal and/or tilted track portions. In particular, horizontal and/or tilted track portions should be provided in at least some sections of the ride.

In particular, the guiding device can comprise a rail or a pair of rails, wherein the two rails preferably can be arranged vertically on top of each other. The rails can be designed as pipes. In particular, the tracks can be arranged on top of each other, that is in the plane, or parallel to the plane, of the pendulum motion.

The axis of the pendulum preferably can be arranged such that the rotational axis is arranged on the chassis between the two rails or pipes. This is a statically favourable solution, as it maintains chassis symmetry. In particular, the symmetry of the chassis is maintained if the rotational axis is between the positions of the vehicle before and after passing through a vertical 180° turn.

The vehicle described in the context of this invention can be a so-called "inverted coaster" or "suspended coaster". This means that the passenger accommodation is arranged below the guiding device during passenger entry/exit. Not only the pendulum axis is arranged above the passengers in this embodiment, but also the chassis. The connecting element and the passenger accommodation hang downward, extending from the chassis like a pendulum. However, in another embodiment, the passenger carrier can be connected directed to the axis which extends out of the vehicle in the viewing direction; it therefore does not necessarily have to be a "suspended coaster". The chassis is arranged on the rails. The normal vector of the chassis stands perpendicular to the direction of travel at any point on the track, and it points in the direction of the guiding device. The connecting element can extend perpendicularly to the normal vector of the chassis. The angle between the direction of travel and the connecting element is variable via the connection which can be swivelled/rotated. In an alternative embodiment, the connecting element extends downward parallel to the normal vector of the chassis. The seats, on the other hand, are arranged such that the viewing direction is oriented transversely, in particular perpendicularly, to the direction of travel. The rotational axis is arranged in the viewing direction in this embodiment as well.

In particular, the track section is designed such that the guiding device defines a track section which is shaped as a vertically oriented arc. The apex of this section can be a highest point. There, the passenger accommodation designed as a pendulum can roll over.

BRIEF DESCRIPTION OF THE DRAWINGS

Further advantages and characteristics of the invention are illustrated by the description of preferred exemplary embodiments based on the drawings. The drawings show.

DETAILED DESCRIPTION OF A PREFERRED EXEMPLARY EMBODIMENT

The exemplary embodiment described in the following relates to a vehicle according to the invention and to a roller-coaster facility according to the invention comprising such a vehicle.

Figure 1:
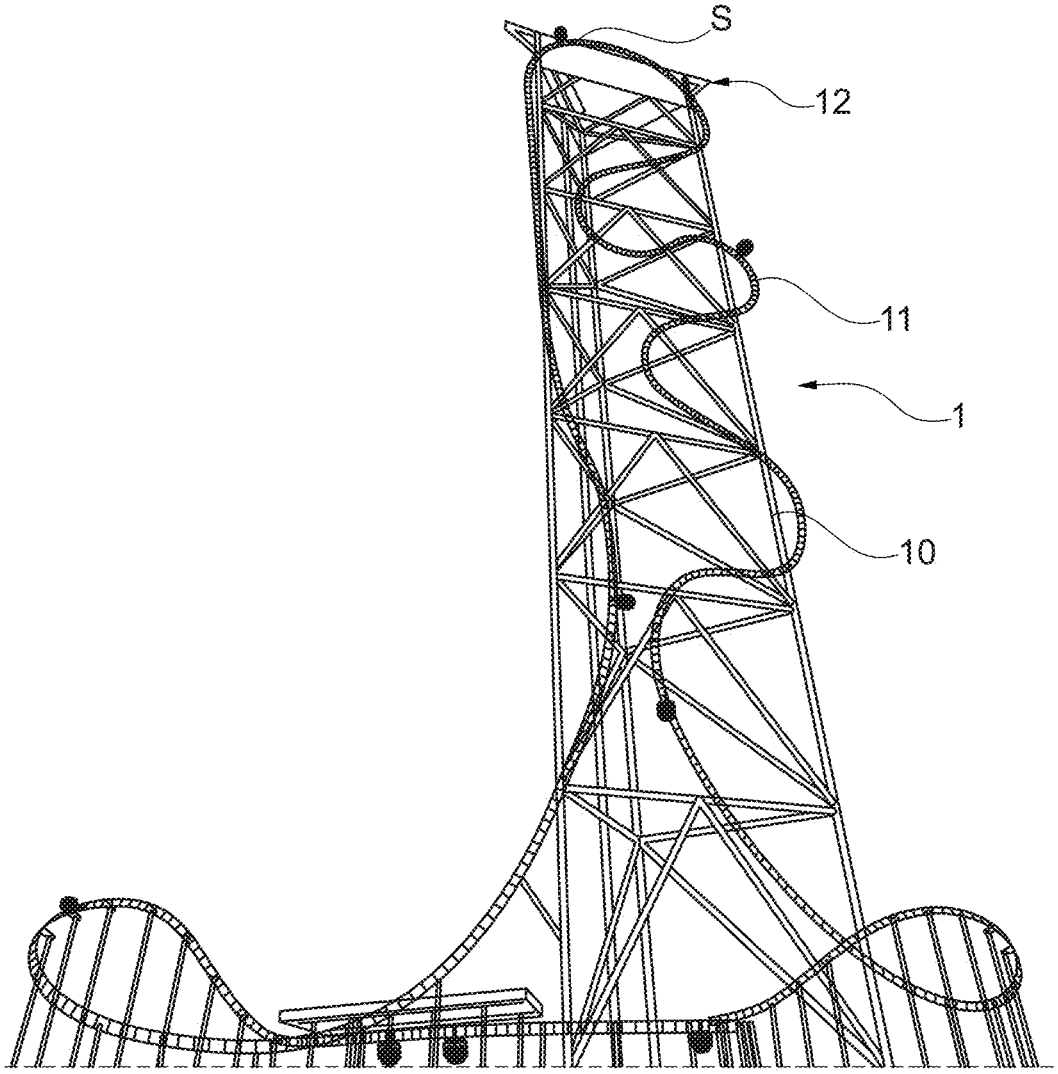
FIG. 1 A schematic representation of a roller-coaster facility according to the invention FIG. 2 A perspective representation of a vehicle according to the invention FIG. 3 Another perspective representation of the vehicle of FIG. 2

FIG. 1 shows an amusement facility 1 in the form of a roller-coaster. The facility has a supporting structure 10 and a rail structure 11 for guiding rail-guided vehicles 2. The track design can be any desired routing; in particular, the rail structure can have turns, spirals, bends and the like. In the exemplary embodiment, the track design has a vertical arc 12, the apex S of which is a highest point.

Figure 3:
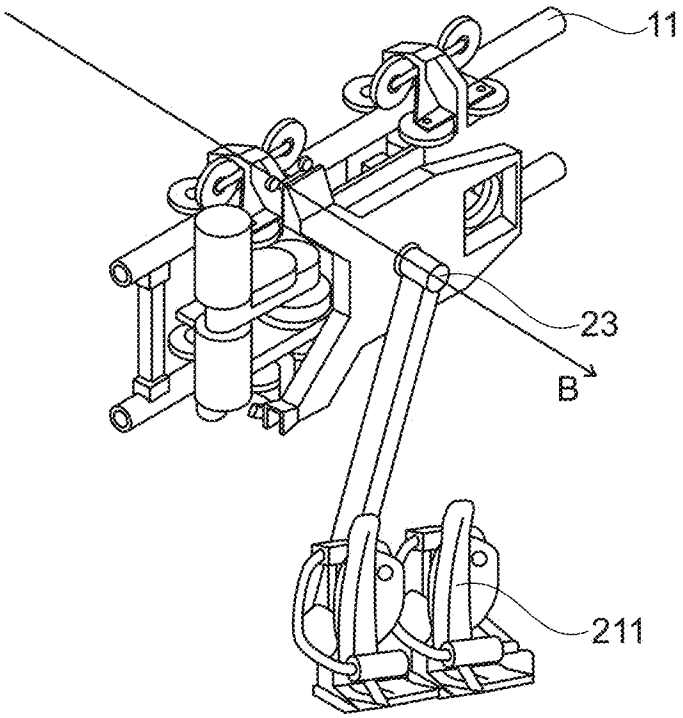
Figure 2:
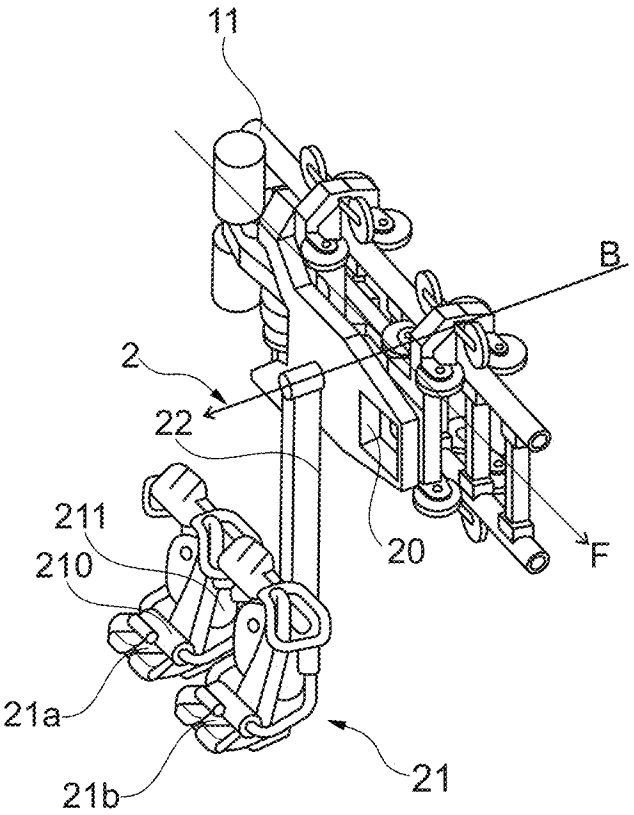

FIGS. 2 and 3 show a vehicle 2 according to the invention, such as can be used in combination with the facility 1 from FIG. 1. The vehicle 2 has a chassis 20, a passenger accommodation 21 and a connecting element 22 in the form a pendulum bar. In this embodiment, one (lower) end of the bar is rigidly connected to the passenger accommodation 21 but could in another embodiment be arranged such that it could be rotated or tilted, that is, it would not be rigid.

The other (upper) end is connected to the chassis 20 via a joint such that it can be rotated and/or tilted. The pendulum 21, 22 is connected to the chassis 20 via a joint 23.

The passenger accommodation 21 has two adjacent seats 21*a* and 21*b*. Each of the seats 21*a*, 21*b* has a seating/seat cushion 210 and a seat back 211. A vector B, which defines the viewing direction, extends perpendicularly to the front surface of the seat back 211. The chassis 20 has a normal line B which is perpendicular to the direction of travel F and which is equivalent to the viewing direction of the passengers or is parallel to said viewing direction, on the one hand, and forms the rotational axis for the swivelling or rotating motion of the passenger accommodation 21 relative to the chassis 20, on the other hand. This means that the rotational or pendulum motions essentially are generated in a plane which is oriented parallel to the direction of travel F. In another embodiment there may be a tilt of the plane of the pendulum motion relative to the normal vector of the chassis of between 0° and 90°. In particular, a tilt of 90° exists between the normal vector and the plane of the rotational motion, i.e. the viewing direction and rotational axis are parallel to the normal vector of the chassis or coincide with the same.

The normal vector typically is assumed to be oriented in the z-direction, or is defined to be the z-direction. However, the vector can also be oriented in the y-direction (transverse to the direction of travel). In the latter embodiment, the rail in FIG. 3 would be turned by 90° in the horizontal plane and the passenger support would remain unchanged.

However, in one alternative embodiment, not shown here, the direction of travel and the viewing direction could be at an angle of less than 90° to each other. In this case, the passenger accommodation would be arranged transversely, but not perpendicularly, to the direction of travel.

Figure 4:
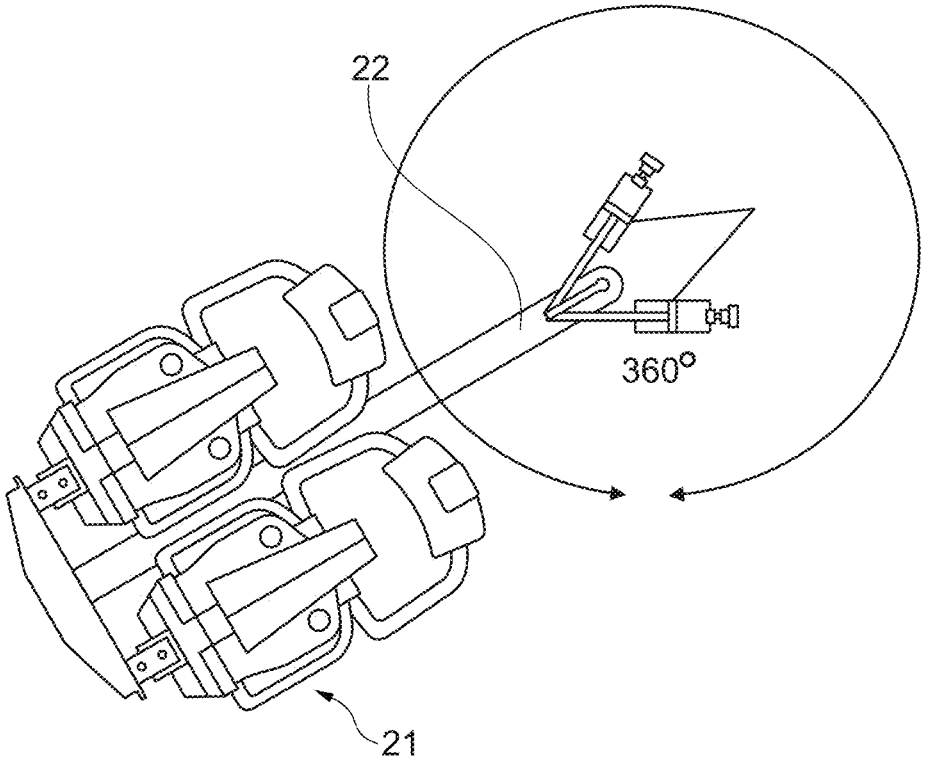
FIG. 4 A top view of the vehicle of FIG. 3 while passing through a turn.

The swivelling/rotating motion preferably is conducted in a plane perpendicular to the viewing direction B, as is illustrated in FIG. 4. The rotational axis B (not labelled in FIG. 4) extends perpendicularly to the picture plane in the centre of the circle suggesting the 360° rotation. The swivelling/rotating motion can be limited, or rotations of 360° can be possible, as is schematically shown in FIG. 4.

The invention claimed is:

1. A rail-guided vehicle comprising:

a passenger accommodation which has at least one seat with a seating and a seat back for the seated accommodation of a passenger, wherein the intended viewing direction of the seated passenger essentially is oriented perpendicularly to the seat back, wherein the seats are arranged such that the viewing direction is oriented transversely to a direction of travel, wherein the passenger accommodation is arranged such that the passenger accommodation swivels or rotates about an axis that is oriented in the viewing direction in order to generate a pendulum effect, wherein the axis for generating the pendulum effect is arranged above the passengers, and wherein the pendulum effect is generated by a pendulum movement of the passenger accommodation, the pendulum movement being performed in a plane which is arranged perpendicularly to the axis, and the plane of the pendulum movement is laterally offset of the rail.

2. The vehicle according to claim 1, wherein the vehicle has a chassis, and wherein the swivelling or rotating motion of the passenger accommodation relative to the chassis is generated by at least one of centrifugal forces and gravitational forces acting upon the passenger accommodation during a ride along a rail structure and a shifting link and a motor drive.

3. The vehicle according to claim 2, wherein the propelling force of an internal drive of the vehicle is transferred positively onto a rail structure.

4. The vehicle according to claim 1, wherein the vehicle has at least one of a dampening and a locking element for dampening or blocking the swivelling and rotating motion, respectively.

5. The vehicle according to claim 4, wherein the propelling force of an internal drive of the vehicle is transferred positively onto a rail structure.

6. The vehicle according to claim 1, wherein the vehicle has an automatic or interactive speed control or a speed control which can be operated in an automatic mode or interactive mode for at least one of generating a specific centrifugal force in a specific portion of the track and controlling the rotational or pendulum motion in a specific portion of the track.

7. The vehicle according to claim 6, wherein the propelling force of an internal drive of the vehicle is transferred positively onto a rail structure.

8. The vehicle according to claim 1, wherein the vehicle is propelled by gravity, by a cable or chain drive, by a linear motor, by a hydraulic or pneumatic cylinder, by friction wheels or by an internal drive.

9. The vehicle according to claim 8, wherein the propelling force of an internal drive of the vehicle is transferred positively onto a rail structure.

10. The vehicle according to claim 1, wherein the propelling force of an internal drive of the vehicle is transferred positively onto a rail structure.

11. An amusement facility comprising:

a guiding device for guiding a vehicle, and a vehicle having a passenger accommodation which has at least one seat with a seating and a seat back for the seated accommodation of a passenger, wherein the intended viewing direction of the seated passenger essentially is oriented perpendicularly to the seat back, wherein the seats are arranged such that the viewing direction is oriented transversely to a direction of travel, wherein the passenger accommodation is arranged such that the passenger accommodation swivels or rotates about an axis that is oriented in the viewing direction in order to generate a pendulum effect, wherein the axis for generating the pendulum effect is arranged above the passengers, wherein the pendulum effect is generated by a pendulum movement of the passenger accommodation, the pendulum movement being performed in a plane which is arranged perpendicularly to the axis, and the plane of the pendulum movement is laterally offset of the rail, and wherein the guiding device defines a track portion, in which a chassis of the vehicle essentially is guided in a vertical plane.

12. The amusement facility (1) according to claim 11, wherein the guiding device defines a track section which is shaped as a vertically oriented arc.

13. The amusement facility according to claim 12, wherein the apex of the vertical arc is a highest point.

14. The amusement facility (1) according to claim 11, wherein the amusement facility is designed as an inverted coaster with a connecting element extending downward from the guiding device in the manner of a pendulum, and wherein one end of the connecting element is connected to a chassis and the other end is connected to the passenger accommodation of the vehicle.

15. An amusement facility comprising:

a guiding device for guiding a vehicle, and a vehicle having a passenger accommodation which has at least one seat with a seating and a seat back for the seated accommodation of a passenger, wherein the intended viewing direction of the seated passenger essentially is oriented perpendicularly to the seat back, wherein the seats are arranged such that the viewing direction is oriented transversely to a direction of travel, wherein the passenger accommodation is arranged such that the passenger accommodation swivels or rotates about an axis that is oriented in the viewing direction in order to generate a pendulum effect, wherein the axis for generating the pendulum effect is arranged above the passengers, wherein the pendulum effect is generated by a pendulum movement of the passenger accommodation, the pendulum movement being performed in a plane which is arranged perpendicularly to the axis, and the plane of the pendulum movement is laterally offset of the rail, and wherein the guiding device defines a track portion, in which the normal vector of a chassis of the vehicle essentially is guided in a vertical plane.

16. The amusement facility (1) according to claim 15, wherein the guiding device defines a track section which is shaped as a vertically oriented arc.

17. The amusement facility (1) according to claim 15, wherein the amusement facility is designed as an inverted coaster with a connecting element extending downward from the guiding device in the manner of a pendulum, and wherein one end of the connecting element is connected to a chassis and the other end is connected to the passenger accommodation of the vehicle.

* * * * *